United States Patent [19]

Vitt

[11] 4,139,045

[45] Feb. 13, 1979

[54] CASTING METHOD AND APPARATUS

[75] Inventor: Gerhard Vitt, Bergisch Gladbach-Schildgen, Fed. Rep. of Germany

[73] Assignee: VKI-Rheinhold & Mahla AG, Fed. Rep. of Germany

[21] Appl. No.: 798,095

[22] Filed: May 18, 1977

[30] Foreign Application Priority Data

May 20, 1976 [DE] Fed. Rep. of Germany ..... 2622552

[51] Int. Cl.[2] ..... B22C 9/04; B22C 15/28

[52] U.S. Cl. ..... 164/34; 164/37; 164/195

[58] Field of Search ..... 164/6, 15, 47, 34, 38, 164/61, 62, 253, 254, 255, 159, 169, 195

[56] References Cited

U.S. PATENT DOCUMENTS

| | | | |
|---|---|---|---|
| 3,572,421 | 3/1971 | Mezey et al. | 164/34 X |
| 3,861,447 | 1/1975 | Hondo | 164/34 |

FOREIGN PATENT DOCUMENTS

| | | | |
|---|---|---|---|
| 789769 | 1/1958 | United Kingdom | 164/34 |

*Primary Examiner*—Richard B. Lazarus
*Assistant Examiner*—John S. Brown
*Attorney, Agent, or Firm*—Steinberg & Blake

[57] ABSTRACT

A casting method and apparatus according to which a molten material is poured into a space occupied by a foam-plastic pattern which is at least partially embedded in a granular material. The foam-plastic pattern when contacted by the molten material decomposes and disappears, while a gas is generated from the contact between the molten material and the foam-plastic pattern. From this generated gas, by way of a suitable structure situated in a mold together with the pattern and granular material, an elevated pressure is created, and the molten material fills the space initially occupied by the foam-plastic pattern in the presence of this elevated pressure which is greater than atmospheric pressure.

16 Claims, 10 Drawing Figures

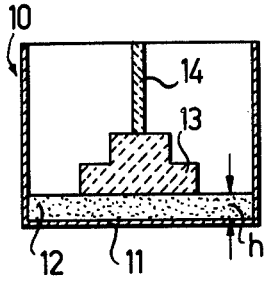
Fig.1
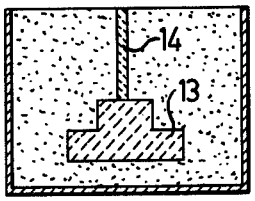
Fig.2
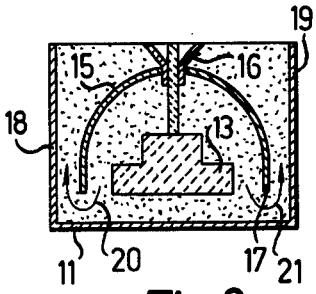
Fig.3
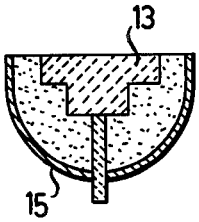
Fig.4
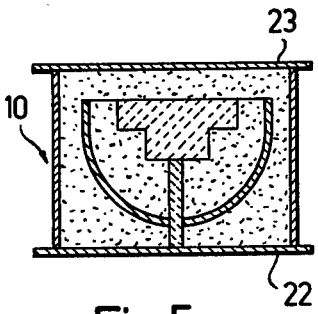
Fig.5
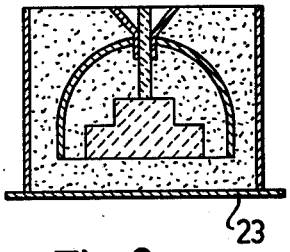
Fig.6
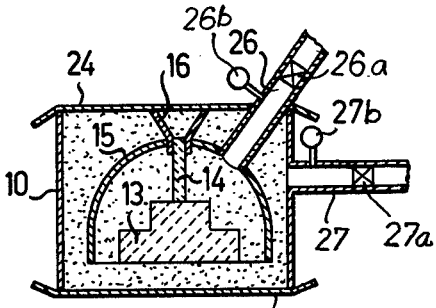
Fig.7
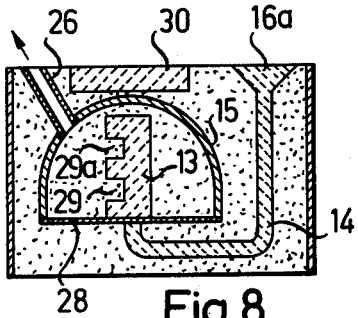
Fig.8
Fig.10
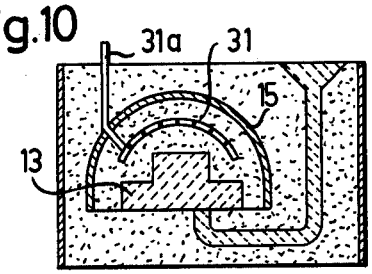
Fig.9
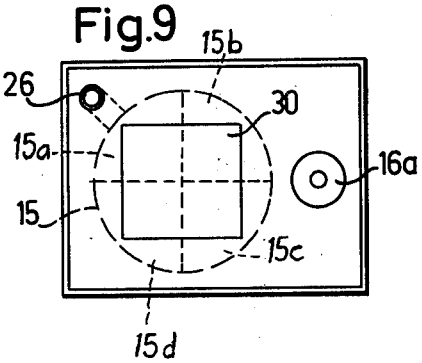

CASTING METHOD AND APPARATUS

BACKGROUND OF THE INVENTION

The present invention relates to methods and apparatus for casting a molten material in a mold which includes a foam-plastic pattern embedded in a binderless granular material such as a suitable sand. The molten material is poured into the space occupied by this foam-plastic pattern, and the pattern upon being contacted by the molten material decomposes, as by being burned away, while at the same time a gas is generated. The foam-plastic pattern becomes replaced by the molten material which thus assumes the configuration of the pattern in the mold.

It is already known to manufacture castings by embedding a foam-plastic pattern in a loose, binderless sand and then replacing the pattern with a molten material such as a molten metal which burns away the pattern with a gas being generated during replacement of the pattern by the molten material. Thus, suitable foam-plastic patterns made of polyurethane or polyvinylchloride have conventionally been embedded in a binderless loose sand with the molten metal being poured into the space occupied by the pattern so as to replace the latter.

Methods and apparatus of this type have the disadvantage of being capable of producing only castings of simple configuration. The reason for this is that the binderless granular material in which the foam-plastic pattern is embedded has only a limited firmness or stiffness which is insufficient to permit complex configurations to be cast. For these reasons a method and apparatus of the above type has not been widely used in connection with the manufacture of castings of complex configuration having undercuts which open outwardly or having hollow interior spaces.

SUMMARY OF THE INVENTION

It is accordingly a primary object of the present invention to provide a method and apparatus which will avoid the above drawbacks.

In particular, it is an object of the present invention to provide a casting method and apparatus which make it possible to cast relatively complex configurations utilizing a foam-plastic pattern embedded in a binderless loose granular material.

Thus, it is an object of the present invention to provide a method and apparatus according to which the loose, binderless granular material has during the time that the molten material replaces the foam-plastic pattern a sufficient stiffness, which is retained during the casting operation, to enable relatively complex configurations to be cast.

Thus, it is an object of the present invention to provide a method and apparatus according to which it becomes possible to provide relatively complex castings having undercuts or the like in a loose, binderless sand or similar granular material.

In accordance with the method of the invention, the molten material such as a suitable molten metal is poured into the space occupied by a foam-plastic pattern which is embedded in a loose, binderless granular material such as a suitable sand. The contact between the pattern and the molten metal or other material results in burning or gasifying of the pattern which finally becomes replaced by the molten metal. In accordance with the invention during the pouring of the molten metal into the mold the gas which is generated by burning or gasifying of the foam-plastic pattern is utilized to create an elevated pressure, greater than atmospheric pressure, in the granular material which surrounds the pattern. As a result of this method of the invention, the elevated pressure which is created in the mold and which results from the pressure of the combustion gases generated from the foam plastic model is utilized to maintain the grains of the binderless granular material in their proper positions so that castings of precise configuration can be achieved.

According to a further feature of the invention, the elevated pressure created in the mold during the casting operation can be regulated. In this way it is possible in a simple manner to adapt the magnitude of the elevated pressure to widely differing requirements such as in accordance with the configuration of the casting which is to be manufactured or in accordance with the particular granular material which has been selected for use in the mold. Thus, the method of the invention, particularly by way of the possibility of regulating the magnitude of the elevated pressure, enables use to be made not only of a quartz type of sand, but also other granular material of relatively great fire-resistant properties, such as, for example, olivine sane, zirconium sand, or even grains of graphite.

A particularly advantageous feature of the invention resides in situating the foam-plastic pattern in a mold box which is then filled with the granular material. Over the granular material there is then placed, by suitable pressure and together with vibrations, a hood which surrounds the foam-plastic pattern and granular material in which it is at least partially embedded. After the hood is thus situated in the mold box, the remaining empty space thereof is filled with the granular material. The hood which is thus embedded in the granular material which surrounds and engages the foam-plastic pattern serves a plurality of functions. In the first place, the pressing of the hood into the granular material serves to pack and render more dense the granular material which becomes situated in the interior of the hood and in which the foam-plastic pattern is at least partially embedded. At the same time, this hood acts as a pressure-elevating means in that an elevated pressure becomes created in the interior of the hood during pouring of the molten material which gasifies or burns the foam plastic.

In many cases it is of advantage to manufacture the mold in such a way that the foam-plastic pattern is situated in the hood and surrounded therein by the granular material, whereupon the hood is closed and placed in a mold box. The space in the mold box which is not occupied by the hood and the granular material and pattern therein is then filled with additional granular material, and finally the thus-filled mold box is inverted through 180° in preparation for pouring the molten material.

In order to pack and render more dense the binderless granular material in the interior of the hood, according to a further feature of the invention the surrounding and embedding of the foam-plastic pattern with the granular material in the interior of the hood is carried out while utilizing vibrations and/or a vacuum. By way of these measures which are used either individually or in combination, the grains which form the granular material create a dense packing, while at the same time closely and tightly surrounding the foam-plastic pattern, and in this way the granular material becomes uniformly spread over and presses against the exterior surface of the pattern extending even into undercut portions thereof or into openings of the pattern which are accessible only from the outside thereof.

Thus, in accordance with the invention, the casting apparatus includes a pressure-elevating means which is situated in the exterior of the mold box and which takes the form of the above-mentioned hood which is situated over and surrounds the foam-plastic pattern while being embedded in the granular material within the mold box. Preferably the hood has an open bottom surrounded by a lower edge of the hood which is spaced upwardly from the bottom of the mold box and inwardly from the side walls thereof. By way of these latter features, it is possible to achieve an automatic reduction of the elevated pressure present in the interior of the hood during the pouring of the molten material. The reduction of the elevated pressure is determined among other factors in accordance with the cross section of the outlet passage for the gas at the lower region of the hood. The hood preferably is made of sheet metal and while possibly being in one piece can also be made, in accordance with a feature of the invention, in a multipartite form, being composed of a number of interconnected hood portions.

According to a further feature of the invention a pipe is connected to and communicates with the interior of the hood for leading gas away from the latter. This pipe serves a pair of functions. In the first place, it may be utilized to create a vacuum in the interior of the hood when the pattern is embedded in granular material in the hood, so that in this way a dense packing of the granular material will be formed in a reliable manner. At the same time, during pouring of the molten material, this pipe, which is provided with a suitable control valve, serves to regulate in a particularly advantageous stepless manner the elevated pressure created in the interior of the hood as a result of the burning of the foam-plastic pattern.

A further feature of the invention resides in providing a second pipe connected to and communicating with the interior of the mold box for leading gas away from the interior of the mold box. This second pipe is of particular advantage in connection with the above-mentioned pipe connected to the hood. The pipe for conducting gas away from the interior of the mold box also serves when connected to a suitable source of vacuum to achieve a tight, dense packing of the granular material, while at the same time being capable also of regulating the gas pressure prevailing in the interior of the mold box and the interior of the hood during the casting operation.

Also, in accordance with the invention the mold box can be covered at its top and bottom by suitable sheets or foils. Also the hood may be advantageously covered at its open bottom end by a suitable sheet or foil, this hood being made, if desired, of two or more parts as pointed out above. The hood is preferably provided with an upper central opening into which a sprue-forming funnel extends for directing the molten material into the space occupied by the foam-plastic pattern. In connection with the feature of covering the open bottom of the hood with a sheet after the hood is filled, it is particularly advantageous also in accordance with the invention to attach to the sheet which covers the open bottom of the hood, preferably by an adhesive material, a gate-forming elongated member which is made of a foam-plastic material.

BRIEF DESCRIPTION OF DRAWINGS

The invention is illustrated by way of example in the accompanying drawings which form part of this application and in which:

FIGS. 1–3 are schematic sectional elevations of various stages in the manufacture of a mold according to the invention;

FIGS. 4–6 are respectively schematic sectional elevations of another embodiment of a method of the invention for manufacturing a mold apparatus of the invention;

FIG. 7 is a schematic sectional elevation of a further embodiment of a mold apparatus of the invention;

FIG. 8 is a schematic sectional elevation of yet another embodiment of a casting apparatus of the invention;

FIG. 9 is a top plan view of the structure of FIG. 8; and

FIG. 10 is a schematic elevation of a further embodiment of a mold according to the invention.

DESCRIPTION OF PREFERRED EMBODIMENTS

Referring now to the drawings, there is shown in FIG. 1 a mold box 10 having a bottom wall 11. Initially, in order to form a bed at the lower region of the mold box 10 a binderless sand 12 is deposited on the bottom wall 11, the layer 12 having a depth h on the order of a few centimeters. Instead of providing such a layer 12 of granular material it is also possible to utilize a fire-resistant plate. A foam-plastic pattern 13 is then situated on the layer 12, this pattern 13 being integral with a gate-forming member 14 in the form of an elongated integral extension of the pattern 13, extending upwardly therefrom as illustrated in FIG. 1. Thus, the foam-plastic gate-forming extension 14 is integral with the pattern 13.

Subsequent to the stage illustrated in FIG. 1, the remaining free space in the interior of the mold box 10 is filled with granular material to provide the structure illustrated in FIG. 2. This granular material is also in the form of a binderless sand.

Then, a pressure-elevating means in the form of a dome-shaped hood 15, having an open bottom, is pressed into the mold box 10 from above preferably while simultaneously vibrating the mold box and the granular material therein. The hood 15 is bell-shaped and is pressed into the mold box until it surrounds the pattern 13 from above, as indicated in FIG. 3. The hood 15 is formed with an upper central opening through which the gate-forming member 14 extends. This opening, however, is large enough to surround the member 14 with sufficient clearance to receive the bottom end of a funnel 16 capable of forming a sprue for receiving the molten metal. The arrangement of the funnel 16 is illustrated in FIG. 3.

After the hood 15 is situated together with the funnel 16 in the interior of the mold box in the manner indicated in FIG. 3, there will be a residual free space in the mold box which is not occupied by granular material, and this free space is then filled with additional granular material so as to provide in this way the structure illustrated in FIG. 3.

The molten material such as a suitable molten metal is initially poured into the funnel 16 so as to fill the latter, and this molten metal will initially gasify the gate-forming member 14 which decomposes upon contact with the molten metal. In this way the molten metal flows down the passage created by the disappearance of the gate-forming member 14 so that the molten metal reaches the pattern 13 while forming a gate at the space initially occupied by the member 14. The burning or gasifying of the foam-plastic pattern 13 takes place in the interior of the pressure-elevating means formed by the hood 15 so that as a result of the contact of the pattern 13 with the molten material an elevated pressure, greater than atmospheric pressure, is created in the interior of the hood 15, thus assuring a casting of precisely determined contour. The hood 15 has a lower edge surrounding the open bottom end thereof, and this lower edge 17 is situated not only above the bottom wall 11 of the mold box but also inwardly of and spaced from the side walls 18 and 19 of the mold box. Thus, as a result of this spacing of the bottom edge 17 of the hood 15 from the bottom and side walls of the mold box, when an intense elevated pressure is created in the interior of the hood 15 by the combustion gases, these gases can flow out of the hood 15 around the lower edge 17 thereof in a manner indicated by the arrows 20 and 21 so that in this way it is possible for the combustion gases to escape.

It is of course to be understood that the size of the distance of the lower edge 17 of the hood 15 from the pattern 13 and the lower wall 11 and side walls 18 and 19 of the mold box determines the magnitude of the cross section of the space through which the combustion gas can flow in order to relieve the elevated pressure, and thus by predetermining the cross section of the path of flow of the combustion gases it is possible to regulate the gas pressure in the interior of the hood 15. At the same time, as a result of the vibrations and pressing utilized in introducing the hood into the granular material, as described above in connection with FIG. 3, the granular material is packed more tightly and rendered more dense, this granular material being a suitable molding sand or a similar binderless granular material.

Thus, with the method and apparatus of FIGS. 1–3 it is possible to cast a molten material such as a suitable molten metal in such a way that a binderless granular material will reliably retain in a highly accurate manner the configuration of the space determined by the pattern 13, and thus it becomes possible to achieve a casting which has a precise configuration. After the molten material solidifies in the mold space initially occupied by the pattern 13, it is of course possible in a conventional way to empty the mold box and remove the casting for further processing which will of course include removing the gate formed in the space initially occupied by the foam-plastic member 14.

In the embodiment of the invention illustrated in FIGS. 4–6, the pattern 13 is initially situated in the hood 15 with the gate-forming extension 14 also extending through the central opening of the hood 15 in the manner apparent from FIG. 4. The space in the hood 15 which is not occupied by the pattern 13 and gate-forming member 14 is then filled with the binderless granular material so as to provide in this way the structure illustrated in FIG. 4. Then, the hood which is filled with the granular material and the pattern is placed in the interior of the mold box 10 in the manner indicated in FIG. 5. The mold box 10 in this case is closed at its bottom by a loose sheet or plate 22. After the structure of FIG. 4 is thus situated in the interior of the mold box 10 of FIG. 5, the space remaining therein is filled with additional granular material so as to provide the structure shown in FIG. 5. Subsequent to the filling of the box 10 with this additional granular material, the top of the box 10 is closed by way of a covering sheet or plate 23. At this time while the plates 22 and 23 are held against the opposed ends of the mold box 10, the entire structure is inverted through 180° so as to provide in this way the structure shown in FIG. 6. After thus inverting the structure of FIG. 5, the covering plate 22 is removed, and it will be noted that the plate 22 is not illustrated in FIG. 6. After removal of the plate 22 the filling funnel 16 is situated in the position indicated in FIG. 6, and the casting operation is then carried out in a manner described above in connection with FIG. 3. It is to be noted that the funnel 16 also may be situated in its proper position when the parts have the condition shown in FIG. 5 prior to being inverted into the condition shown in FIG. 6.

According to FIG. 7, the mold box also contains the binderless granular material in which there is embedded the pressure-elevating means in the form of the hood 15 as well as the foam-plastic pattern 13 and gate-forming member 14 which are situated together with granular material in the interior of the hood 15 as illustrated in FIG. 7. It will be noted that a funnel 16 is also provided. In this embodiment the mold box is closed at its top and bottom by sheets or foils 24 and 25 made of a suitable plastic material. In the embodiment of FIG. 7, a pipe 26 is connected to and communicates with the interior of the hood 15, this pipe 26 serving to conduct gas away from the interior of the hood 15. For adjusting the flow of gas through the pipe 26, the latter is provided with a suitable regulating valve **26*a*. A side wall of the box 10 is operatively connected with a second pipe 27 which thus is operatively connected to the mold box 10 and communicates with the interior thereof, this pipe 27 also serving to conduct gas away from the interior of the mold box 10 and having a regulating valve 27*a***.

During formation of the mold structure of FIG. 7, the pipe 26, while the valve **26*a* is open, is connected with a source of suction such as a suitable vacuum pump, thus creating in the interior of the hood 15 a vacuum which results in a tight, dense packing of the granular material in the hood 15 when the pattern 13 and gate-forming member 14 are situated in the hood 15 and surrounded by the granular material therein. At the same time, when the mold structure of FIG. 7 is initially formed a vacuum also communicates with the interior of the mold box 10 through the pipe 27 while the valve 27*a*** is open. This vacuum created in the interior of the mold box also results in a tight dense packing of the grains of granular material in the mold box.

However, during pouring of the molten material into the space occupied by the pattern 13 and gate-forming member 14, this molten material being introduced through the funnel 16 after the sheet 24 is removed, it is possible to regulate the gas pressure in the hood 15 and in the mold box 10 by adjusting the valves **26*a* and 27*a*, the initial elevated pressure being created in the hood 15 by closing the valve 26*a* so as to assure in this way a creation of an elevated pressure in the interior of the hood 15. At the same time, while the valve 26*a* is closed it is possible to maintain the pipe 27 in communication with the source of vacuum so as to suck in this way the combustion gases out of the interior of the hood 15 while maintaining a predetermined elevated pressure therein. Of course if the pressure in the hood 15 is too great it is also possible to reduce the pressure by partially opening the valve 26*a***. As is schematically indicated in FIG. 7, the pipes 26 and 27 respectively carry pressure gauges 26*b* and 27*b* so that it is possible to see from these gauges the prevailing pressures in the interior of the hood 15 and in the interior of the mold box 10, and from these pressures it is possible to determine suitable adjustments for the valves 26*a* and 27*a*.

According to the embodiment of the invention which is illustrated in FIGS. 8 and 9, the open bottom end of the hood 15 is covered and closed by way of a sheet or foil 28 made of a plastic material. Of course, prior to closing the bottom open end of the hood 15 the foam-plastic pattern 13 together with granular material are situated in the interior of the hood 15 as illustrated. This hood 15 of FIGS. 8 and 9 is also provided with a pipe 26 operatively connected thereto and communicating with the interior thereof. This pipe serves during the initial placing of the pattern 13 and granular material in the interior of the hood 15 to provide a vacuum in the interior of the hood 15 so that the grains of the granular material will form a dense tight packing over the entire surface of the pattern 13, except the lower surface thereof, as viewed in FIG. 8, so that in this way there is an assurance that the granular material will conform precisely to the configuration determined by the exterior surface of the pattern 13. As is indicated, in the particular example of FIGS. 8 and 9 the pattern 13 has a plurality of undercuts 29, 29*a* which because of the above vacuum become completely filled with the granular material. Preferably, in addition to the vacuum provided in the interior of the hood 15 when initially packing the pattern 13 in the granular material, the hood 15 and the granular material therein together with the pattern 13 are subjected to vibrations, to contribute in this way also to the achievement of a dense tight packing of granular material against the exterior surface of the pattern. In the example of FIGS. 8 and 9, an elongated gate-forming member 14 of foam plastic is embedded in the granular material which is situated in the mold box at the exterior of the hood 15, and one end of the elongated foam-plastic gate-forming member 14 is adhered to the lower surface of the plastic sheet 28 in alignment with the pattern 13 as illustrated. In this example the sprue-forming funnel takes the form of a body 16*a* which is also made of foam plastic and which is integral with the elongated member 14. However, if desired it is also possible to use instead of ceramic funnel connected with the elongated member 14. In this example a suitable weight 30 is situated in the granular material of the mold box above the hood 15 so as to increase the pressure against the exterior of the hood 15. The pipe 26 of FIGS. 8 and 9 is provided with a valve and gauge similar to those shown in FIG. 7, and during the casting operation this valve is closed to a greater or lesser extent depending upon the elevated pressure which is desired in the interior of the hood 15.

As has been indicated above, the hood 15 need not be made of a one-piece sheet material. Instead it can be composed of a plurality of parts, and a multipartite hood 15 is indicated schematically in FIG. 9 made up of four sections 15*a*–15*d*, as schematically illustrated. These sections are interconnected with each other in any suitable way.

According to the embodiment of the invention which is illustrated in FIG. 10, there is situated in the interior of the hood 15 a tubular means 31 which has an elongated tubular portion 31*a* extending through an opening in the hood 15 to the exterior of the mold box. The tubular means 31 is formed with a plurality of small openings or apertures so that gas in the granular material in the interior of the hood 15 can enter through these apertures into the interior of the tube 31 to be drawn out through the extension 31*a* thereof. In this case also a suitable valve may be connected with the extension 31*a* at the exterior of the mold box, together with a suitable pressure gauge, so that it is possible in this way to regulate the pressure in the interior of the hood 15, thus giving the possibility of maintaining this pressure at an optimum value. Except for these features the embodiment of FIG. 10 is similar to that of FIG. 8 except that the gate-forming foam-plastic member 14 is integral with and connected directly to the pattern 13. A plastic sheet 28 is not utilized in FIG. 10. Of course this plastic sheet 28 of FIG. 8 will melt when engaged by the molten material which burns away the member 14 so that the molten material will have free access through the sheet 28 to the foam-plastic pattern 13.

It is of particular advantage to utilize in the interior of the hood granular material of a very high quality fire-resistant property, such as, for example, zirconium sand or particles of graphite, while the granular material at the exterior of the hood 15 is preferably of a lesser quality while at the same time it being also in the form of a binderless sand or other granular material. Also, to form a high quality granular material it is possible to use sand together with small steel balls.

During shaking or vibration of the high quality granular material in the interior of the hood so as to envelop the foam-plastic pattern, particularly when the pattern has undercuts, it is desirable to tilt the hood, a number of times, in different angular directions, simultaneously with the shaking or vibration of the hood, so as to stiffen the loose sand or other granular material in order to achieve a tight dense filling of the granular material into the innermost parts of the undercuts.

The extent of vacuum provided at the pipes 26, 27 or tube 31 in general is insufficient to suck sand out of the hood 15 or mold box 10. However, it is possible to situate at the ends of pipes 26 and 27 which are respectively connected to the hood and mold box an apertured plate or mesh the openings of which are too small to permit the granular material to pass therethrough while at the same time the gas can be sucked through such a mesh or apertured plate. In the same way the interior of tube 31 can lined with a tubular mesh the openings of which are too small to permit the sand to pass therethrough.

What is claimed is:

1. In a casting method, the steps of at least partially embedding a foam-plastic pattern in a binderless granular material to form in the granular material a mold space occupied by and having its configuration determined by said pattern, said embedding step including initially situating the foam-plastic pattern within a mold box, filling the mold box with the granular material which thus surrounds at least part of the pattern, then situating around the granular material which engages the pattern a hollow hood which is placed in the mold box in a position where the pattern and granular material engaging the same become situated in the interior of said hollow hood, a part of the interior of the mold box being left without granular material as a result of the introduction of the hood into the mold box, and then filling the latter part of the interior of the mold box with additional granular material, pouring into said space a molten material which reacts with said foam-plastic pattern to replace the latter in said space while the pattern disappears and while a gas is generated by contact between the molten material and the foam-plastic pattern, and creating from the latter generated gas in the granular material which defines at least part of said mold space an elevated pressure greater than atmospheric pressure said hood receiving at least part of the generated gas for creating said elevated pressure, and in the presence of said elevated pressure the molten material fills said space so that the molding of the molten material into the configuration of said space takes place at said elevated pressure and regulating the magnitude of said elevated pressure.

2. In a method as recited in claim 1 and including the steps of initially situating the pattern at least partly in the interior of a hood, then filling the interior of the hood while the pattern is situated at least partly in the interior thereof with granular material, then placing the thus-filled hood with the pattern situated at least partly therein in the interior of a mold box, the latter having a hollow interior part of which is not occupied by the hood when the latter is situated in the mold box, then filling the latter part of the interior of the mold box with additional granular material, and finally inverting the thus-filled mold box in preparation for pouring the molten material into the space occupied by the pattern, said hood receiving at least part of said generated gas for creating said elevated pressure.

3. In a method as recited in claim 1 and wherein while the hood is placed around the granular material in which the pattern is at least partially embedded the latter granular material is vibrated while the mold box is turned to a number of different angular attitudes.

4. In a method as recited in claim 3 and wherein the granular material in addition to being vibrated is placed under a vacuum while the hood is situated around the granular material and the pattern at least partially embedded therein.

5. In a casting apparatus, a foam-plastic pattern and a binderless granular material in which said pattern is at least partially embedded for defining in the granular material a mold space occupied by and having its configuration determined by said pattern, so that when a molten material is poured into said mold space the pattern will react with the molten material to disappear and be replaced by the molten material which thus assumes the configuration of said mold space, and the reaction of said pattern with the molten material generating a gas, and pressure-elevating means including a hollow hood in the interior of which at least part of said pattern is situated together with granular material in which the pattern is at least partially embedded, said pressure-elevating means cooperating with the granular material in which the pattern is at least partially embedded for receiving the generated gas and for creating therefrom an elevated pressure greater than atmospheric pressure and in the presence of which the molten material fills said mold space so that the molding of the molten material into the configuration of said space takes place at said elevated pressure.

6. The combination of claim 5 and wherein a mold box has a hollow interior in which said hood is situated together with said granular material and pattern, said hood having an open bottom and a lower edge surrounding said open bottom thereof, and said mold box having a bottom end above which said open bottom of said hood is situated as well as side walls which are spaced outwardly beyond said hood, so that the generated gas received in said hood can flow out of the latter around said lower edge thereof through the space between said side walls of said mold box and said hood.

7. The combination of claim 5 and wherein a pipe is operatively connected to and communicates with the interior of said hood for conducting gas away from the interior of said hood.

8. The combination of claim 7 and wherein a mold box has a hollow interior in which said hood together with said granular material and pattern are situated, and a second pipe operatively connected to and communicating with the interior of said mold box for conducting gas away from the interior thereof.

9. The combination of claim 8 and wherein said mold box has top and bottom ends, and a pair of sheets extending across and closing said top and bottom ends of said mold box.

10. The combination of claim 5 and wherein said hood is a multipartite member having a plurality of interconnected hood portions.

11. The combination of claim 5 and wherein said hood has an upper portion formed with an opening passing therethrough, and funnel means operatively connected with said hood and communicating with the interior thereof through said opening for directing molten material into said space.

12. The combination of claim 5 and wherein said hood has a bottom end, a sheet extending across and closing said bottom end of said hood, said pattern being situated within said hood in engagement with said sheet while being embedded in granular material within said hood, and a mold box within which said hood is situated and having a bottom end above which said sheet is situated, said mold box being filled with additional granular material surrounding said hood and extending beneath said sheet, and an elongated foam-plastic gate-forming member embedded in said additional granular material and having an end engaging said sheet at a lower surface region thereof above which said pattern is situated, so that the molten material may be poured into the space occupied by said gate-forming member to decompose the latter while flowing toward and through said sheet into the space occupied by said pattern, said sheet being made of a material which when contacted by the molten material permits the latter to form an opening through said sheet.

13. The combination of claim 12 and wherein said end of said gate-forming member is adhered to said sheet.

14. The combination of claim 5 and wherein said hood is formed with an opening passing therethrough, and a foam-plastic gate-forming member integral with said pattern and extending therefrom through and beyond said opening of said hood so that molten material can be poured into the space occupied by said gate-forming member to cause the latter to become decomposed while the molten material flows to the space occupied by said pattern.

15. The combination of claim 5 and wherein a perforated tubular means is situated in said hood in the granular material therein while having an extension extending through part of said hood to the exterior thereof, so that generated gas will be received in the interior of said perforated tubular means to be conducted thereby out of said hood.

16. The combination of claim 5 and wherein a regulating means cooperates with said pressure-elevating means for regulating the extent to which pressure created from the generated gas is elevated.

* * * * *